US007640898B2

(12) United States Patent
Tsubouchi et al.

(10) Patent No.: US 7,640,898 B2
(45) Date of Patent: Jan. 5, 2010

(54) WATER-COOLED INTERNAL COMBUSTION ENGINE

(75) Inventors: Masanori Tsubouchi, Wako (JP); Nobuo Suzuki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 155 days.

(21) Appl. No.: 11/728,965

(22) Filed: Mar. 27, 2007

(65) Prior Publication Data

US 2007/0227473 A1 Oct. 4, 2007

(30) Foreign Application Priority Data

Mar. 29, 2006 (JP) ..... 2006-092001
Mar. 29, 2006 (JP) ..... 2006-092002

(51) Int. Cl.
*F01N 7/06* (2006.01)

(52) U.S. Cl. ..... 123/41.82 R; 123/41.31; 123/41.74; 440/88 C; 440/88 G; 440/89 B; 440/89 C

(58) Field of Classification Search ..... 123/41.01, 123/41.31, 41.32, 41.72, 41.82 A, 41.82 R; 165/51, 52; 60/320, 321; 440/88 C, 88 G, 440/88 J, 89 B, 89 C
See application file for complete search history.

(56) References Cited

U.S. PATENT DOCUMENTS 5,036,804 A * 8/1991 Shibata ..... 123/41.74
5,970,926 A * 10/1999 Tsunoda et al. ..... 123/41.29
6,295,963 B1 * 10/2001 Kollock et al. ..... 123/193.5
6,327,853 B1 * 12/2001 Fujii et al. ..... 123/41.82 R
7,044,089 B2 * 5/2006 Yamada ..... 123/41.82 R
7,240,644 B1 * 7/2007 Slike et al. ..... 123/41.82 R
2002/0170510 A1 * 11/2002 Iizuka et al. ..... 123/41.84

FOREIGN PATENT DOCUMENTS

JP 2000-159190 6/2000

* cited by examiner

*Primary Examiner*—Michael Cuff
*Assistant Examiner*—Hung Q Nguyen
(74) *Attorney, Agent, or Firm*—Carrier, Blackman & Associates P.C.; Joseph P. Carrier; William D. Blackman

(57) ABSTRACT

A water-cooled internal combustion engine has a cylinder head 21 provided with a cylinder head water jacket $J_h$ through which cooling water flows. The cylinder head water jacket $J_h$ includes a combustion chamber water jacket 70 surrounding combustion chambers 26 and an exhaust passage water jacket 71 around an exhaust manifold passage 38. The exhaust gas discharged from the combustion chambers 26 through exhaust ports 28 flows through the exhaust manifold passage. The exhaust passage water jacket 71 is divided into an upstream water jacket 72*a* and a downstream water jacket 72*b* by a partition wall 75. The cooling water flows from both the upstream water jacket 72*a* and the downstream water jacket 72*a* into the combustion chamber water jacket 70. Equality in temperature between a combustion chamber wall and an exhaust passage wall is improved and the cylinder head 21 is heated in a uniform temperature distribution.

5 Claims, 12 Drawing Sheets

WATER-COOLED INTERNAL COMBUSTION ENGINE

BACKGROUND OF THE INVENTION

1. Field of the Invention

The present invention relates to a water-cooled internal combustion engine cooled by circulating cooling water. More specifically, the invention relates to a structure forming water jackets in the cylinder head of a water-cooled internal combustion engine to be applied to, for example, an outboard motor.

2. Description of the Related Art

The cylinder head of a known water-cooled internal combustion engine disclosed in, for example, JP-A 2000-159190 is provided with an exhaust manifold passage through which the exhaust gas discharged from a plurality of combustion chambers flows, and water jackets including a combustion chamber water jacket surrounding combustion chambers and an exhaust passage water jacket surrounding the exhaust manifold passage.

When the exhaust manifold passage is formed in the cylinder head, it is preferable, in view of improving the durability of the cylinder head, to reduce differences in temperature among combustion chamber walls forming the combustion chambers and exhaust passage walls forming the exhaust passages including the exhaust manifold passage, i.e., to make the temperatures of the combustion chamber walls and the exhaust passage walls uniform. The combustion chamber water jacket has an intricate arrangement of passages because the cylinder head is provided with intake valves, exhaust valves and ignition plugs. Thus the cooling water has difficulty in smoothly flowing through the combustion chamber water jacket as compared with flowing through the exhaust passage water jacket having a comparatively simple arrangement of passages. Therefore, if the combustion chamber water jacket and the exhaust passage water jacket are connected simply, the respective temperatures of the combustion chamber walls and the exhaust passage walls are likely to differ from each other and the uniformity of temperature distribution in the cylinder head is worsened.

Generally, the exhaust passage water jacket and the exhaust passages including the exhaust manifold passage are formed, for example, by cores placed in a master mold for casting the cylinder head. Although it is preferable to surround a large part of the exhaust manifold passage by a water jacket to cool the exhaust passage walls forming the exhaust manifold passage efficiently, a casting mold including cores having an intricate shape is needed to form such a water jacket surrounding cores for forming the exhaust manifold passage. The mold and cores having such an intricate shape increases the manufacturing cost of the cylinder head. When only the exhaust passages are formed by using cores, not to mention when both the water jackets and the exhaust passages are formed by using cores, it is desirable that positions of core supports for supporting the cores in the master mold do not make the mold for forming the water jackets intricate and facilitate supporting the cores in the master mold. When a through hole for receiving an exhaust gas measuring device is extended through the water jacket, the area of parts of the exhaust passage walls covered with the water jacket decreases and the exhaust passage wall cooling effect is reduced accordingly.

The present invention has been made in view of the foregoing problems and it is therefore an object of the present invention to improve the uniformity of temperature distribution on the combustion chamber walls and the exhaust passage walls of a water-cooled internal combustion engine provided with an exhaust manifold passage to improve the uniformity of temperature distribution in the cylinder head of the water-cooled internal combustion engine.

Another object of the present invention is to provide a water-cooled internal combustion engine provided with an exhaust passage water jacket having a simple shape, surrounding an exhaust manifold passage formed in the cylinder head, and capable of exercising a necessary cooling effect and of facilitating supporting cores for forming an exhaust manifold passage. A further object of the present invention is to facilitate placing a core for forming an exhaust manifold passage in a mold, to improve the stability of the core for forming the exhaust manifold passage, to facilitate parting molds and to reduce the cost of a cylinder head by avoiding increasing through holes opening into the exhaust manifold passage.

SUMMARY OF THE INVENTION

A water-cooled internal combustion engine in an aspect of the present invention includes: a cylinder block provided with a plurality of cylinders aligned in a row; and a cylinder head defining combustion chambers respectively corresponding to the cylinders, and provided with an exhaust manifold passage into which exhaust gas discharged from the combustion chambers through exhaust ports flows, and a cylinder head water jacket for cooling water including a combustion chamber water jacket surrounding the combustion chambers and an exhaust passage water jacket around the exhaust manifold passage; wherein the exhaust passage water jacket is divided into an upstream water jacket and a downstream water jacket by a flow restricting means, and a part on the upstream side of the flow restricting means of the upstream water jacket is connected to the combustion chamber water jacket(70) to make the cooling water flow from the upstream water jacket into the combustion chamber water jacket.

The flow restricting means dividing the exhaust passage water jacket into the upstream and the downstream water jacket forces the cooling water into the combustion chamber water jacket. Therefore, the amount of the cooling water used for cooling the combustion chamber walls is large as compared with that can be used for the same purpose when the flow restricting means is used and hence the combustion chamber walls can be effectively cooled by the sufficient cooling water. An exhaust passage wall forming the exhaust manifold passage is cooled by the cooling water flowing through the exhaust passage water jacket on the upstream side of the combustion chamber water jacket. The exhaust passage walls are cooled by the cooling water flowing through the exhaust passage water jacket, and the combustion chamber walls are cooled effectively by a large quantity of the cooling water. Consequently, the uniformity of temperature distribution in the combustion chamber walls and the exhaust passage walls can be improved and the uniformity of temperature distribution in the cylinder head is improved.

According to the present invention, the downstream water jacket can be connected to the combustion chamber water jacket so that the cooling water flowing through the downstream water jacket may flow from a part on the downstream side of the flow restricting means of the downstream water jacket into the combustion chamber water jacket.

Thus the cooling of the combustion chambers is promoted and the uniformity of temperature distribution in the cylinder head is further improved because the cooling water flows also through the downstream water jacket into the combustion chamber water jacket.

According to the present invention, the cylinder head of the water-cooled internal combustion engine may be provided with connecting passages through which part of the cooling water flowing in the upstream water jacket flows into the downstream water jacket.

The cooling water that has thus flowed from the upstream water jacket into the downstream water jacket promotes cooling the exhaust passage walls forming the exhaust manifold passage.

Preferably, the exhaust passage water jacket serves also as a bypass water jacket through which part of the cooling water flowing in the upstream water jacket flows into the downstream water jacket.

Thus part of the cooling water flowing in the upstream water jacket flows through the bypass water jacket into the downstream water jacket. Therefore, the exhaust passage wall forming the exhaust manifold passage is cooled by the cooling water flowing through the bypass water jacket. Use of the cooling water flowing through the bypass water jacket in addition to the cooling water flowing through the upstream and the downstream water jacket for cooling the exhaust passage wall forming the exhaust manifold passage promotes cooling the exhaust passage wall forming the exhaust manifold passage.

Preferably, the exhaust passage water jacket has an inlet, the upstream water jacket has an inlet, and those inlets coincide with each other.

Thus the combustion chamber wall and the exhaust passage wall can be concurrently effectively cooled, and the cooling water flows in a serial flow from the exhaust passage water jacket into the combustion chamber water jacket.

Preferably, an inlet of the cylinder head water jacket of the cylinder head serves as inlets of the exhaust passage water jacket, and an outlet of the cylinder head water jacket serves also as an outlet of the combustion chamber water jacket.

Thus the cooling water flows directly from the exhaust passage water jacket into the combustion chamber water jacket, and the exhaust passage wall forming the exhaust manifold passage and the combustion chamber wall can be effectively cooled by the cooling water flowing through the exhaust passage water jacket.

A water-cooled internal combustion engine in a further aspect of the present invention includes: a cylinder block provided with a plurality of cylinders; and a cylinder head defining combustion chambers respectively corresponding to the cylinders, provided with an exhaust manifold passage into which the exhaust gas discharged from the combustion chambers flows, and a cylinder head water jacket including an exhaust passage water jacket around the exhaust manifold passage, and formed by casting using a mold; wherein the exhaust passage water jacket and the exhaust manifold passage are ones formed by cores, respectively, in the mold, the exhaust passage water jacket includes a first exhaust passage water jacket nearer to the combustion chambers and a second exhaust passage water jacket farther from the combustion chambers, the first and the second exhaust passage water jacket extend on the opposite sides, with respect to a direction parallel to the axes of the cylinders, of the exhaust manifold passage, respectively, the cylinder head is provided with an outlet of the exhaust manifold passage and a through hole spaced part from the outlet of the exhaust manifold passage and opening into the exhaust manifold passage, and the through hole is formed between the first and the second exhaust passage water jacket.

An exhaust passage wall forming the exhaust manifold passage is cooled effectively by the cooling water flowing through the first and the second exhaust passage water jacket extending on the opposite sides, with respect to a direction parallel to the axes of the cylinders, of the exhaust manifold passage, respectively. The core placed in the mold to form the exhaust manifold passage can be held by using parts of the mold for forming the outlet of the exhaust manifold passage and the through hole spaced apart from the outlet. Since the through hole is formed between the first and the second exhaust passage water jacket extending on the opposite sides, with respect to a direction parallel to the axes of the cylinders, of the exhaust manifold passage, respectively, the complexity of the respective shapes of the first and the second exhaust passage water jacket is not augmented, the core can be easily held and the cylinder head can be manufactured at a low manufacturing cost.

Preferably, the first exhaust passage water jacket nearer to the combustion chambers and the second exhaust passage water jacket farther from the combustion chambers do not overlap the exhaust manifold passage and the through hole entirely as viewed from a position farther from a center plane including the axes of the cylinders than the exhaust manifold passage.

Thus a core for forming the exhaust manifold passage can be inserted into the mold from a position on a side of the exhaust manifold passage farther from the cylinders without being interfered with by parts of the mold for forming the first and the second exhaust passage water jacket.

The outlet of the exhaust manifold passage and the through hole are at the opposite end parts of the exhaust manifold passage with respect to a direction parallel to the row of the plurality of cylinders, respectively. The core for forming the exhaust manifold passage is supported at positions a long distance apart from each other with respect to the direction parallel to the row of cylinders. Since supports supporting the core for forming the exhaust manifold passage are spaced a long distance apart from each other, the core can be stably supported.

The outlet of the exhaust manifold passage may open in the joining surface of the cylinder head to be joined to the cylinder block, and the through hole may be extend through the cylinder head parallel with the joining surface.

The mold supporting the core for forming the exhaust manifold passage can be removed in a direction parallel to the joining surface in which the outlet opens, which facilitates parting molds. Since the molds can be readily parted, the molds can be properly parted and hence the cylinder head can be manufactured at a low manufacturing cost.

The through hole can holds therein any one of measuring devices including an exhaust gas measuring device for measuring properties of the exhaust gas or any one of tubular members (93) including a sampling tube for sampling the exhaust gas, a tube opening into the atmosphere and a secondary air supply tube for supplying secondary air for exhaust emission control.

The through hole formed to facilitate supporting the core for forming the exhaust manifold passage is used for receiving a measuring device or a tubular member. Therefore, any additional through hole specially for receiving the measuring device or the tubular member is not necessary. Since the through hole does not extend through the water jacket, the area of a part of the exhaust manifold passage surrounded by the water jacket is not decreased by the through hole for receiving the detecting device or the tubular member. Thus any additional through hole is not formed, the cylinder head can be manufactured at a low manufacturing cost, and the reduction of the cooling effect of the cooling water flowing through the water jacket can be prevented.

DESCRIPTION OF THE PREFERRED EMBODIMENTS

A water-cooled internal combustion engine E in a preferred embodiment of the present invention will be described with reference to FIGS. 1 to 12.

Figure 1:
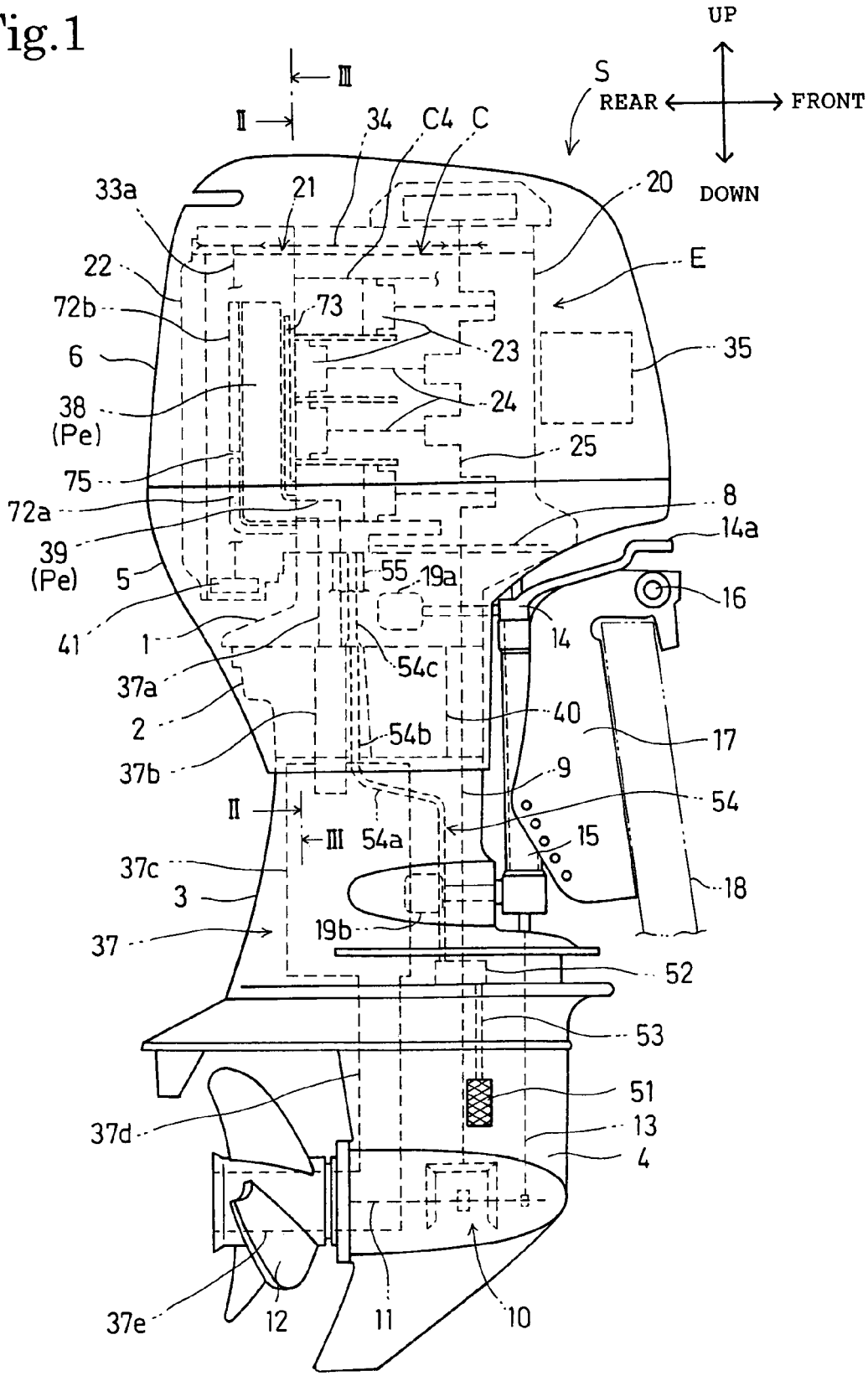
FIG. 1 is a side elevation of an outboard motor provided with a water-cooled internal combustion engine in a preferred embodiment of the present invention taken from the right-hand side of the outboard motor.

Referring to FIG. 1, the water-cooled internal combustion engine E is incorporated into an outboard motor S, namely, a marine propulsion device. The outboard motor S includes the water-cooled internal combustion engine E, namely, a vertical engine, provided with a vertical crankshaft 25. The water-cooled internal combustion engine E has a mount case 1 having an upper end joined to the water-cooled internal combustion engine E and a lower end, an oil case 2 joined to the lower end of the mount case 1, an extension case 3 connected by the oil case 2 to the mount case 1, a gear case 4 joined to the lower end of the extension case 3, a vertically extending under cover 5 surrounding a lower part of the water-cooled internal combustion engine E, the mount case 1, the oil case 2 and an upper part of the extension case 3, and an engine cover 6 detachably attached to the upper end of the under cover 5.

In this specification, the terms "vertical", "longitudinal" and "lateral" are used for indicating directions, positions and such in relation with the outboard motor S mounted on a hull 18.

A power transmission system for transmitting the power of the water-cooled internal combustion engine E of the outboard motor S to a propeller 12 includes a flywheel 8 mounted on a lower end part of the crankshaft 25, a drive shaft 9 connected to the lower end of the crankshaft 25 for rotation together with the flywheel 8, a reversing mechanism 10 formed in the gear case 4 and including a bevel gear mechanism and a clutch mechanism, and a propeller shaft 11 on which the propeller 12 is mounted. The drive shaft 9 extends vertically downward from the interior of the mount case 1 through the extension case 3 into the gear case 4. The drive shaft 9 is connected through the reversing mechanism 10 to the propeller shaft 11. The reversing mechanism 10 is operated by turning a shift rod 13 extended through a swivel shaft 14 to set the reversing mechanism 10 selectively in a forward propulsion state or a backward propulsion state. The power of the water-cooled internal combustion engine E is transmitted from the crankshaft 25 through the drive shaft 9, the reversing mechanism 10 and the propeller shaft 11 to the propeller 12 to drive the propeller 12 for rotation.

A mounting device for mounting the outboard motor S on the hull 18 has the swivel shaft 14 provided with an operating member 14*a*, a swivel case 15 supporting the swivel shaft 14 for turning thereon, a tilting shaft 16 supporting the swivel shaft 14 so as to be turnable, and a bracket 17 holding the tilting shaft 16 and attached to the stern frame of the hull 18. The swivel shaft 14 has an upper end part fixedly held on the mount case 1 by a mount rubber 19*a*, and a lower end part fixedly held on the extension case 3 by a mount rubber 19*b*. The mounting device holds the outboard motor S so as to be turnable on the tilting shaft 16 in a vertical plane relative to the hull 18 and so as to be turnable on the swivel shaft 14 in a horizontal plane.

Referring to FIGS. 2 to 5, the water-cooled internal combustion engine E, which is a straight multiple-cylinder four-stroke internal combustion engine, has an engine body including a cylinder block C provided with four vertically arranged cylinders C1 to C4, a crankcase 20 joined to the front end surface of the cylinder block C, a cylinder head 21 joined to the rear end surface of the cylinder block C with a gasket held between the cylinder block C and the cylinder head 21, and a head cover 22 attached to the rear end of the cylinder head 21. The respective lower ends of the cylinder block C and the crankcase 20 are fastened to the upper end of the mount case 1 with bolts.

Pistons 23 are axially slidably fitted in the cylinders C1 to C4 and are connected to the crankshaft 25 by connecting rods 24, respectively. The crankshaft 25 is disposed in a chamber defined by the front end of the cylinder block C and the crankcase 20 and is supported for rotation in main bearings on the cylinder block C and the crankcase 20.

Figure 4:
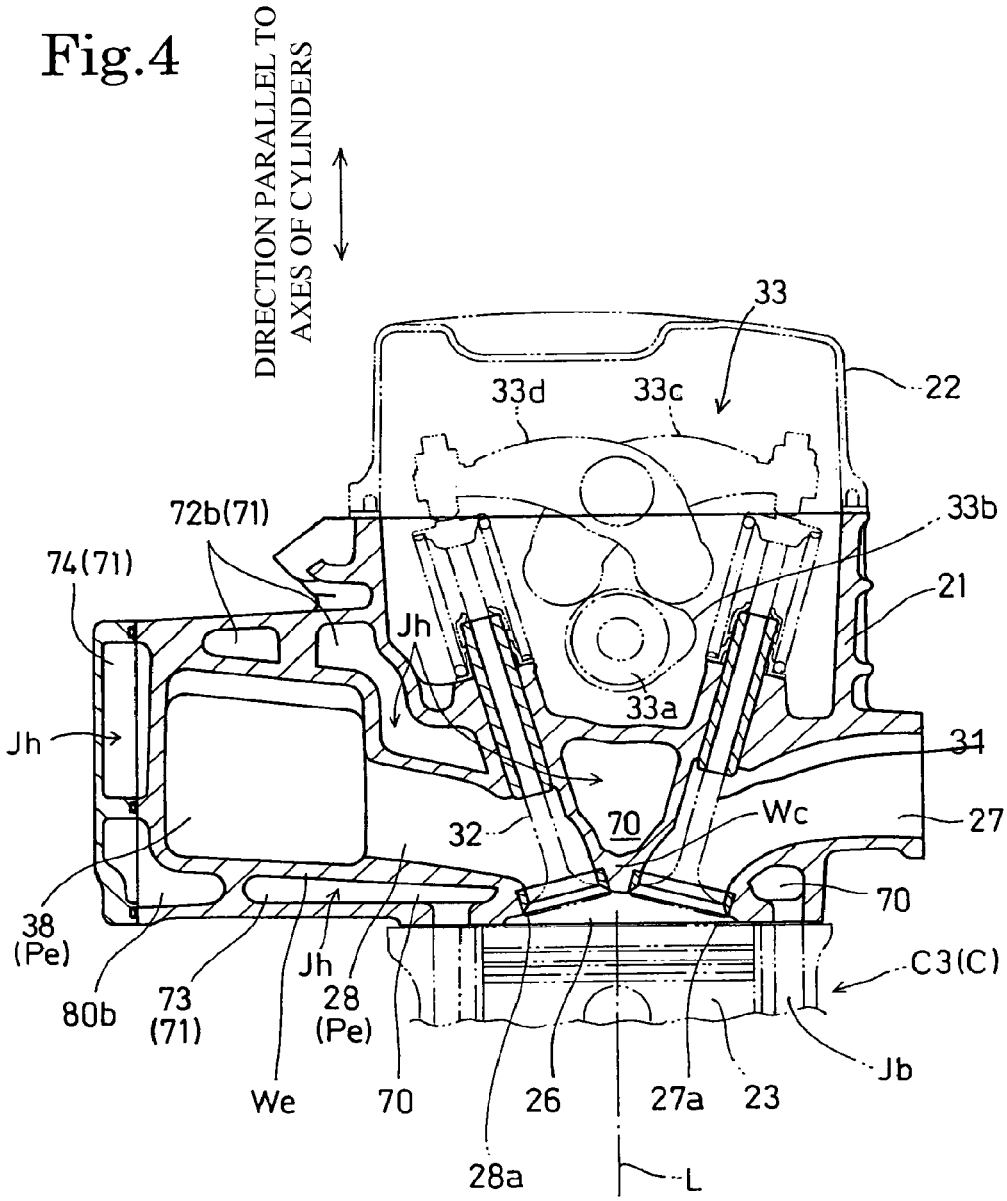
FIG. 4 is a sectional view taken on the line IV-IV in FIG. 3.

Referring to FIG. 4, the cylinder head 21 is provided with combustion chambers 26 respectively facing the pistons 23 fitted in the cylinders C1 to C4 with respect to a direction parallel to the axes L of the cylinders C1 to C4, intake ports 27 each having a pair of intake openings 27*a* opening into the combustion chamber 26, exhaust ports 28 each having a pair of exhaust openings 28*a* opening into the combustion chamber 26, and spark plug holding bores 30 (FIGS. 5, 7 and 9) respectively for holding spark plugs 29.

The cylinder head 21 is provided with intake valves 31 respectively for closing and opening the intake openings 27*a*, and exhaust valves 32 respectively for closing and opening the exhaust ports 28*a*. The intake valves 31 and the exhaust valves 32 are opened and closed in synchronism with the rotation of the crankshaft 25 by an overhead-camshaft type valve train 33 disposed in a valve train chamber defined by the cylinder head 21 and the head cover 22. The valve train 33 includes a camshaft 33*a* provided with cams 33*b* (FIG. 4), intake rocker arms 33*c* driven by the cams 33*b*, and exhaust rocker arms 33*d* driven by the cams 33*b*. The camshaft 33*a* is rotatably supported by bearing parts 21*a* (FIG. 5) and is driven for rotation by the crankshaft 25 through a transmission mechanism 34 (FIG. 1) including a timing chain or the like. The intake valves 31 and the exhaust valves 32 are driven for opening and closing through the intake rocker arms 33*c* and the exhaust rocker arms 33*d*, respectively, by the cams 33*b*.

The water-cooled internal combustion engine E is provided with an intake system. The intake system includes a throttle body 35 (FIG. 1) disposed in front of the crankcase 20, a throttle valve placed in the throttle body 35 to control intake air, and an intake pipe for carrying intake air metered by the throttle valve to the intake ports 27. The intake air flowing through an intake passage in the intake system is mixed with fuel spouted by each of fuel injection valves 36 (FIG. 5) attached to the cylinder head 21 to produce an air-fuel mixture. The air-fuel mixture is sucked through the intake port 27 into the combustion chamber 26. The air-fuel mixture taken into the combustion chamber 26 is ignited by the spark plug 29. The air fuel mixture burns to produce a combustion gas. The piston 23 is driven for reciprocation by the pressure of the combustion gas. The reciprocating piston 23 drives the crankshaft 25 for rotation through the connecting rod 24. The combustion gas is discharged as an exhaust gas from the combustion chamber 26 into an exhaust passage Pe (FIG. 1) including the exhaust ports 28. The exhaust gas flows through an exhaust guide passage 37 and is discharged to the outside of the outboard motor S.

The exhaust guide passage 37 guides the exhaust gas flowing through the exhaust passage Pe to the outside of the outboard motor S. As shown in FIG. 1, the exhaust guide passage 37 includes a passage 37*a* formed in the mount case 1, a passage 37*b* defined by an exhaust guide pipe extended downward in the oil case 2 attached to the mount case 1, an expansion chamber 37*c* formed in the extension case 3 to receive the exhaust gas from the passage 37*b*, a passage 37*d* formed in the gear case 4 to receive the exhaust gas from the expansion chamber 37*c*, and a passage 37*e* formed in the boss of the propeller 12 to discharge the exhaust gas flowing through the passage 37*d* into the water.

Referring to FIGS. 1 and 4 to 7, the exhaust passage Pe formed in the engine body includes cylinder head exhaust passages 28 and 38 (FIG. 4) and a cylinder block exhaust passage 39 (FIG. 1). The cylinder head exhaust passage 28 and 38 are the exhaust ports 28 and the exhaust manifold passage 38 connected to the exhaust ports 28. The exhaust gas flows through the exhaust ports 28 into the exhaust manifold passage 38.

The exhaust manifold passage 38 extends in the direction parallel to the row of the cylinders C1 to C4 parallel to the axis of the crankshaft 25. The exhaust manifold passage 38 extends in a range corresponding to that in which the cylinders C1 to C4 are arranged. The exhaust manifold passage 38 has a lower end part 38*a* (FIG. 7) having an outlet 38*e* (FIGS. 3 and 7) opening in the joining surface 21*a* of the cylinder head 21 to be joined to the joining surface 21, of the cylinder block C.

For example, the lower end part is a first end part and the upper end part is a second end part in this specification.

Referring to FIGS. 1, 2, 8A and 8B, the cylinder block exhaust passage 39 is formed in an L-shape in a lower end part of the cylinder block C. The cylinder block exhaust passage 39 has one end opening in the joining surface $C_s$ of the cylinder block C so as to be connected to the outlet 38*e* (FIG. 3) of the exhaust manifold passage 38, and the other end opening in a joining surface $C_m$ to be joined to the mount case 1 so as to be connected to the passage 37*a* (FIG. 1) formed in the mount case 1. The exhaust gas flows from the exhaust manifold passage 38 through the exhaust passage 39, the passage 37*a* and the exhaust guide passage 37 in that order and is discharged into the water.

Figure 2:
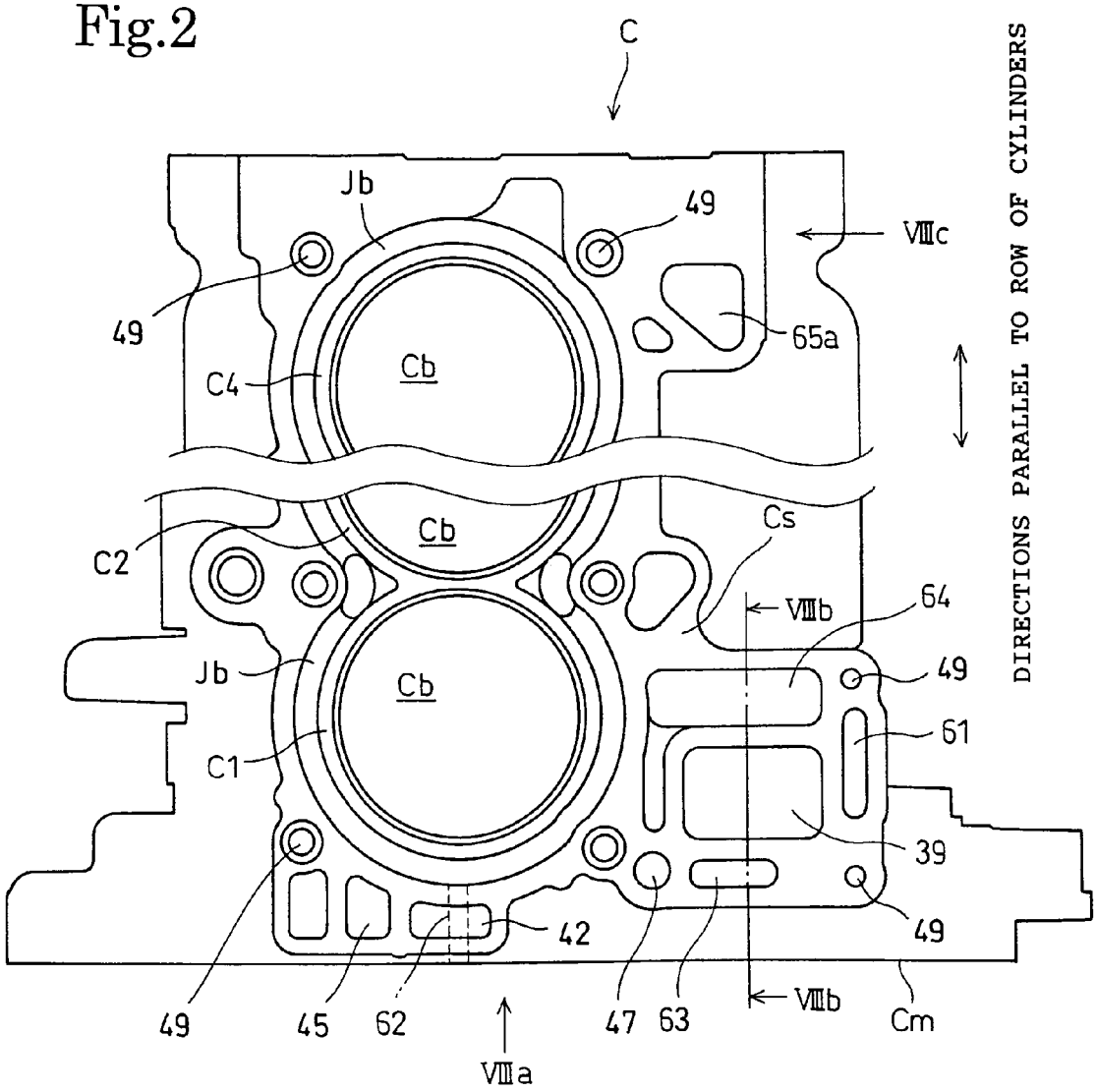
FIG. 2 is a view taken in the direction of the arrow II in FIG. 1 showing an essential part of a cylinder block included in the water-cooled internal combustion engine.
Figure 3:
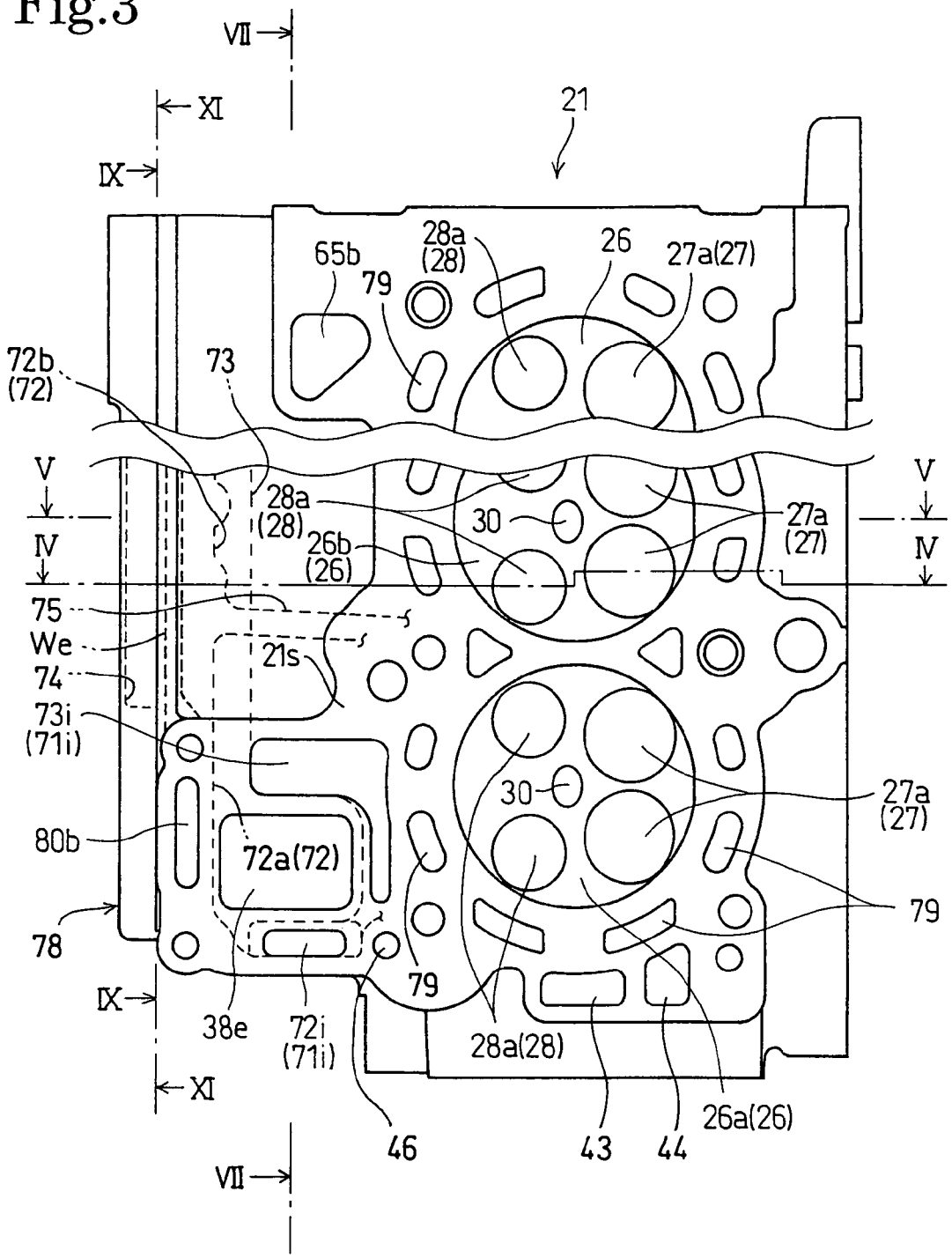
FIG. 3 is a view taken in the direction of the arrow III in FIG. 1 showing an essential part of a cylinder head included in the water-cooled internal combustion engine.

Referring to FIGS. 1 to 3, the lubricating system of the water-cooled internal combustion engine E includes an oil pan 40 placed in the oil case 2, an oil pump 41 held on the cylinder head 21 and driven by the camshaft 33*a*, and oil passages. The oil pump 41 pumps up the lubricating oil from the oil pan 40. The lubricating oil is then caused to flow through a suction passage formed in the mount case 1, a suction passage 42 (FIG. 2) formed in the cylinder block C, and a suction passage 43 (FIG. 3) formed in the cylinder head 21. The lubricating oil is then caused to flow through a supply passage 44 formed in the cylinder head 21 and a supply passage 45 formed in the cylinder block C into a main oil gallery formed in the cylinder block C. The lubricating oil is distributed by the main oil gallery to moving parts requiring lubrication. The lubricating oil used for lubricating the moving parts returns to the oil pan 40 through return oil passages formed in the cylinder block C and the cylinder head 21 including a return passage 46 formed in the cylinder head 21 and shown in FIG. 3, and a return passage 47 formed in the cylinder block C and shown in FIG. 2, and a return passage formed in the mount case 1. The cylinder head 21 is fastened to the cylinder block C with bolts screwed in threaded holes 49 formed in the cylinder block C.

As shown in FIG. 1, the cooling system of the water-cooled internal combustion engine E includes a water intake 51 formed in the gear case 4 so as to be submerged in the water, a water pump 52 held in the extension case 3 and driven by the drive shaft 9, a water intake passage 53 extending through the gear case 4 and the extension case 3 to carry cooling water taken through the water intake 51 to the water pump 52, a cooling water supply passage 54 extending through the extension case 3, the oil case 2 and the mount case 1 to carry the cooling water discharged from the water pump 52 to the water-cooled internal combustion engine E, a cooling water passage system formed in the engine body to distribute the cooling water supplied through the cooling water supply passage 54 in the engine body, a drain passage 55 formed in the mount case 1 to discharge the cooling water received from the cooling water passage system into the extension case 3, a thermostat valve 56 (FIG. 8D) placed in the cooling water passage system, and a thermostat valve 57 (FIG. 11B) placed in the cooling water passage system.

The cooling water supply passage 5 includes a water passage 54*a* defined by a conduit extending upward from the water pump 52, and water passages 54*b* and 54*c* respectively formed in the oil case 2 and the mount case 1. The cooling water flows through the water passages 54*a*, 54*b* and 54*c* to a supply port 60 (FIG. 8A).

The cooling water passage system includes the supply port 60 (FIG. 8A), namely, a recess formed in the joining surface $C_m$ of the cylinder block C, a cylinder block water jacket $J_b$ (FIG. 2) formed in the cylinder block C so as to surround the cylinder bores $C_b$ of the cylinders C1 to C4, a cylinder head water jacket $j_h$ (FIG. 4) formed in the cylinder head 21 so as to extend over the combustion chambers 26 and the cylinder head exhaust passages 28 and 38, a drain port 61 (FIGS. 2 and 8A), and water passages formed in the cylinder block C and the cylinder head 21. The cooling water flows from the supply passage 54 into the supply port 60. The drain port 61 is formed in the cylinder block C so as to open in the joining surface $C_m$ of the cylinder block C. The cooling water is discharged through the drain port 61 into the drain passage 55 of the mount case 1.

Figure 6:
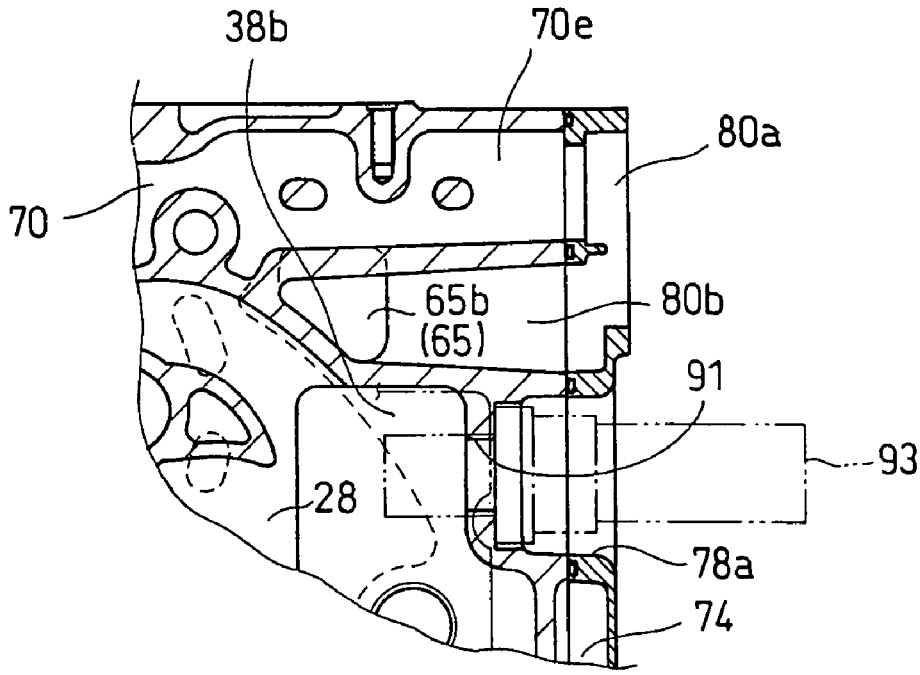
FIG. 6 is a schematic sectional view taken on the line VI-VI in FIG. 9.
Figure 8A:
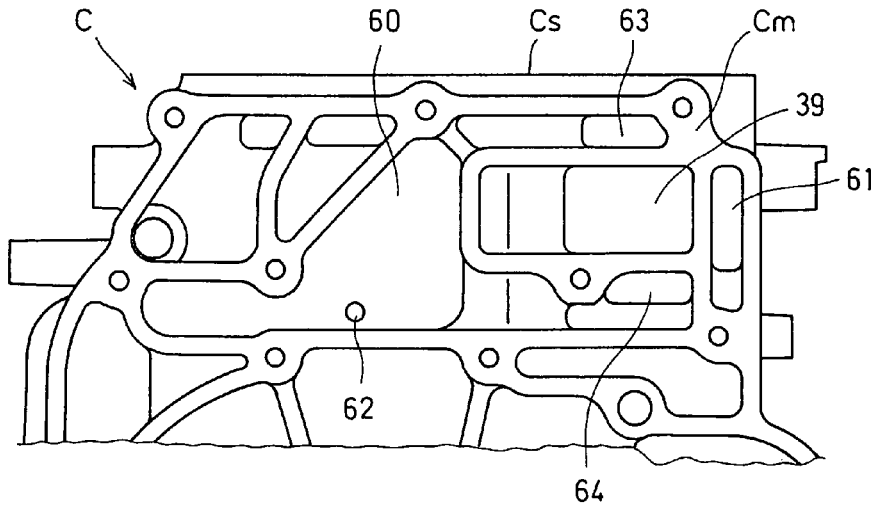
FIG. 8A is a view taken in the direction of the arrow VIIIa in FIG. 2.
Figure 8B:
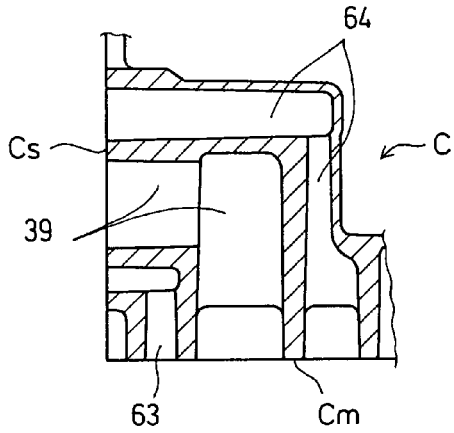
FIG. 8B is a view taken on the line VIIIb-IIIb in FIG. 2.
Figure 8C:
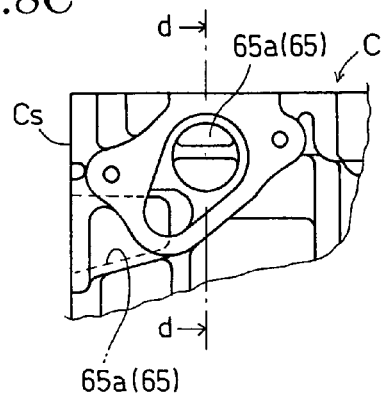
FIG. 8C is a view taken in the direction of the arrow VIIIc in FIG. 2.
Figure 8D:
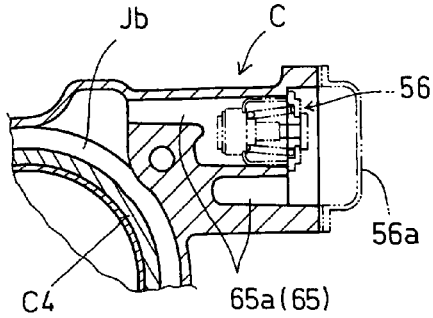
FIG. 8D is a sectional view taken on the line d-d in FIG. 8C.
Figure 9:
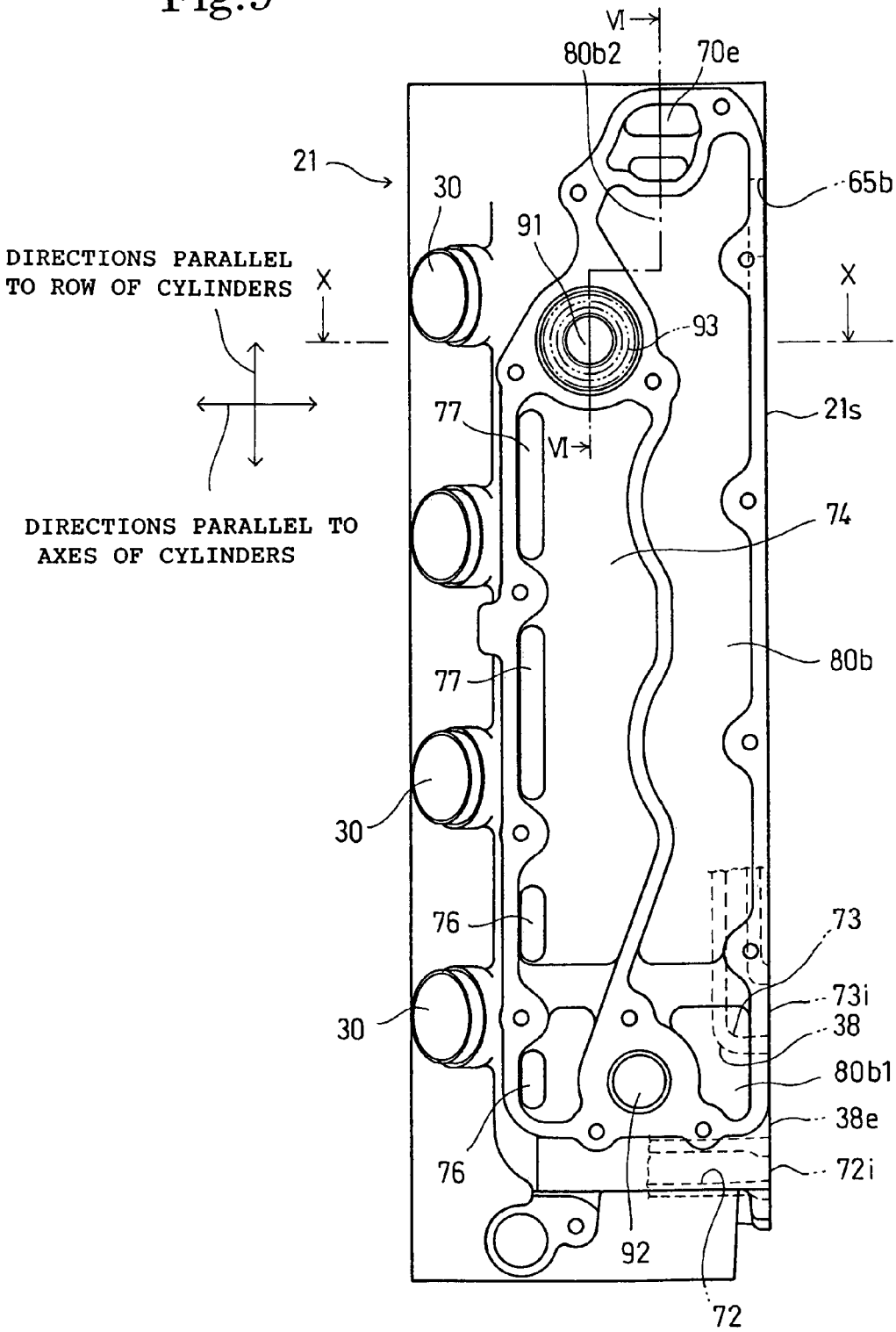
FIG. 9 is a view taken in the direction of the arrow IX in FIG. 3.

Referring to FIGS. 2 and 8A, the respective inlets of a first inlet water passage 62, a second inlet water passage 63 and a third inlet water passage 64 formed in the cylinder block C are connected to the supply port 60 of the cylinder block C. The outlet of the first inlet water passage 62 opens into the water jacket $J_b$ to supply the cooling water from the supply port 60 into the water jacket $J_b$. The cooling water that has flowed through the water jacket $J_b$ to cool the cylinders C1 to C4 flows through a cylinder block outlet water passage 65 (FIGS. 8C and 8D) formed in the cylinder block C into an outlet water passage 80 (FIGS. 4 and 11A) formed in the cylinder head 21. The cylinder block outlet water passage 65 includes a water passage 65*a* (FIG. 8D) formed in the cylinder block C, and a water passage 65*b* (FIG. 6) formed in the cylinder head 21. The water passage 65*a* has an inlet opening into the water jacket $J_b$ and an outlet opening in the joining surface $C_s$ and provided with the thermostat valve 56 (FIG. 8D). As shown in FIGS. 6 and 9, the water passage 65*b* has an inlet opening in the joining surface 21*s* so as to be connected to the water passage 65*a*, and an outlet opening into an outlet water jacket 80*b*. A thermostat cover 56*a* is attached to the cylinder block C as shown in FIG. 8D.

Referring to FIGS. 2 and 8A, the L-shaped inlet water passages 63 and 64 extending along the cylinder block exhaust passage 39 have outlets opening in the joining surface $C_s$. The cooling water flows from the supply port 60 through the second inlet water passage 63 and the third inlet water passage 64, cooling an exhaust passage wall forming the exhaust passage 39, and flows into the cylinder head water jacket $j_h$ (FIG. 4). The cooling water flows between the joining surfaces 21*s* and $C_s$ through openings formed in a gasket held between the joining surfaces 21*s* and $C_s$.

Figure 5:
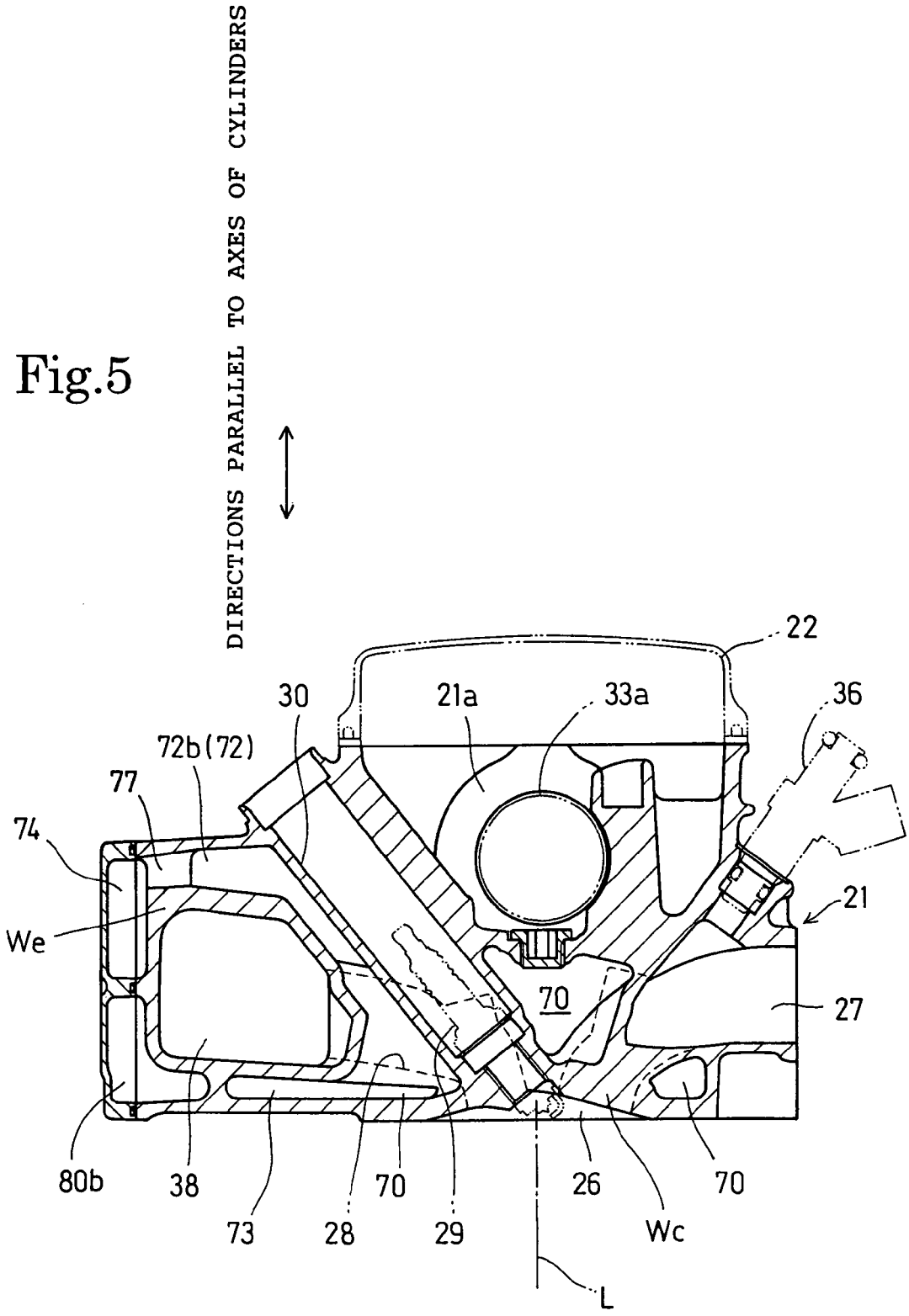
FIG. 5 is a sectional view taken on the line V-V in FIG. 3.

Referring to FIGS. 4 and 5, the cylinder head water jacket $j_h$ includes a combustion chamber water jacket 70 extending around the combustion chambers 26, and an exhaust passage water jacket 71 extending around the exhaust manifold passage 38. The combustion chamber water jacket 70 and the exhaust passage water jacket 71 connect together at a position nearer to a plane including the center axes of the cylinders than the exhaust manifold passage 38. A part surrounding an exhaust passage wall $W_e$ forming the exhaust manifold passage 38 of the cylinder head water jacket $j_h$ will be referred to as the exhaust passage water jacket 71 and the rest of the cylinder head water jacket $j_h$ will be referred to as the combustion chamber water jacket 70 for convenience.

In the description of the embodiment and in the appended claims, parts and positions nearer to the combustion chambers 26 or the cylinder block C and those farther from the combustion chambers 26 or the cylinder block C than members and parts of the cylinder head 21 with respect to a direction parallel to the center axes of the cylinders will be referred to as parts and positions on "the near side of the combustion chamber" and parts and positions "on the far side of the combustion chamber", respectively. Parts and positions on the exhaust side of the cylinder head 21 on which the exhaust manifold passage 38 is positioned and nearer to a center plane containing the center axes of the cylinders C1 to C4, namely, a plane containing the axis of at least one of the cylinders and parallel to the axis of the crankshaft, and those farther from the plane with respect to a direction perpendicular to the center plane are referred to as parts and positions "on the near side of the center plane" and those "on the far side of the center plane", respectively.

Referring to FIGS. 4 to 7, 9 and 10, the exhaust passage water jacket 71 includes a water jacket 72 on the far side of the combustion chamber, a water jacket 73 on the near side of the combustion chamber spaced apart from the water jacket 72 in a direction parallel to the axes of the cylinders, and a side water jacket 74 extending on the far side of the center plane (the right side in this embodiment) so as to cover the exhaust manifold passage 38.

The water jacket 72 on the far side of the combustion chamber and the water jacket 73 on the near side of the combustion chamber are of a flat shape with respect to a direction parallel to the axes of the cylinders and are on the opposite sides, respectively, of the exhaust manifold passage 38 with respect to the direction parallel to the axes of the cylinders. The water jackets 72 and 73 extend in a range corresponding to at least two of the cylinders C1 to C4. In this embodiment, the range corresponds to all the four cylinders C1 to C4. Thus the cooling water can flow smoothly from the water jacket 72 on the far side of the combustion chamber and the water jacket on the near side of the combustion chamber into the combustion chamber water jacket 70. Consequently, the irregularity of temperature distribution in combustion chamber walls $W_c$ separating the adjacent combustion chambers 26 is reduced and the uniformity of the temperatures of the combustion chamber walls $W_c$ is improved.

When the exhaust manifold passage 38, the water jacket 72 on the far side of the combustion chamber and the water jacket 73 on the near side of the combustion chamber are viewed from a position farther from the center plane than the exhaust manifold passage 38, the water jackets 72 and 73 do not entirely cover the exhaust manifold passage 38 and two through holes 91 and 92 (FIG. 9) from the far side of the center plane with respect to the exhaust manifold passage 38.

Therefore, when the combustion chamber water jacket 70 and the exhaust passage water jacket 71 are formed by a single water jacket core of a casting mold, and the exhaust passage including the exhaust ports 28 is formed by a single exhaust passage core of the casting mold in forming the cylinder head 21 in the casting mold, the exhaust passage core can be easily inserted from the far side of the center plane toward the center plane in a space between a part for forming the water jacket 72 on the far side of the combustion chamber and a part for forming the water jacket on the near side of the combustion chamber of the water jacket core. Those cores are made of a material such that the core can be destroyed to take out a casting from the mold after casting.

Figure 10:
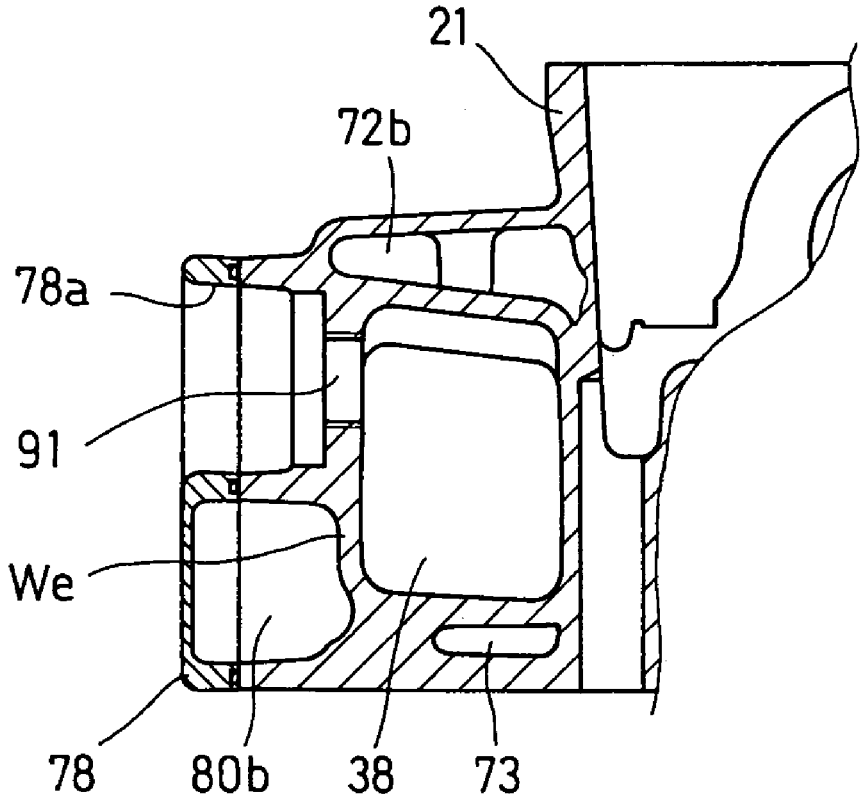
FIG. 10 is a sectional view taken on the line X-X in FIG. 9, in which a cover is held in place.
Figure 11A:
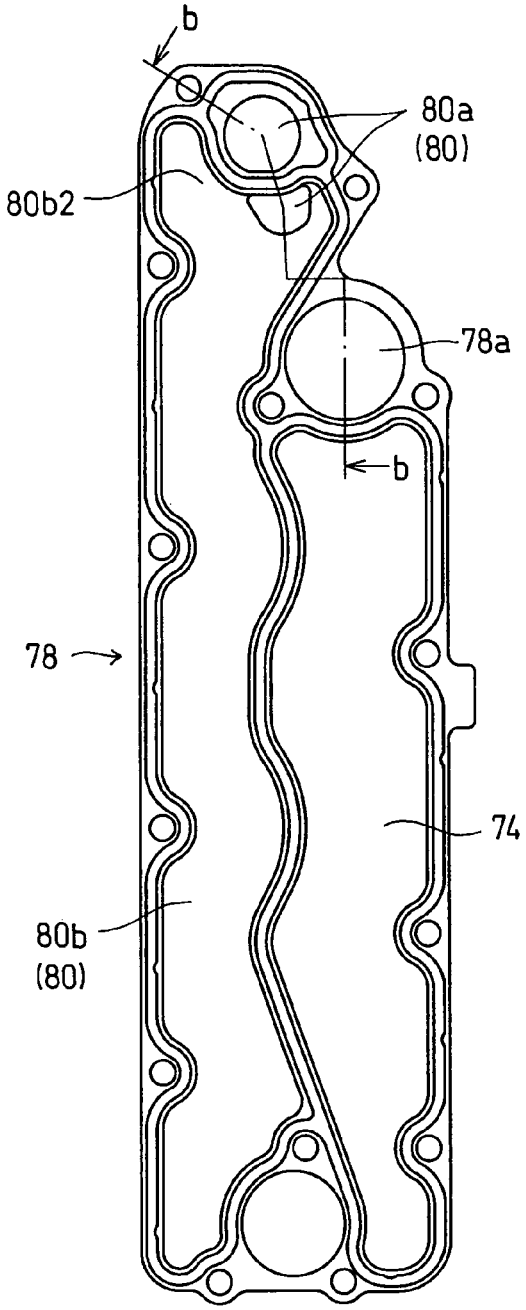
FIG. 11A is a view taken in the direction of the arrow XI in FIG. 3.
Figure 11B:
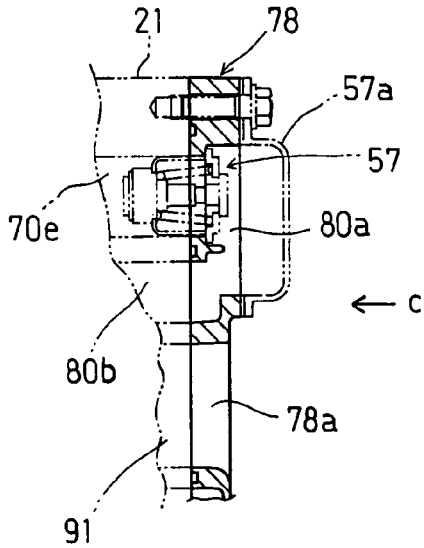
FIG. 11B is a sectional view taken on the line b-b in FIG. 11A.
Figure 11C:
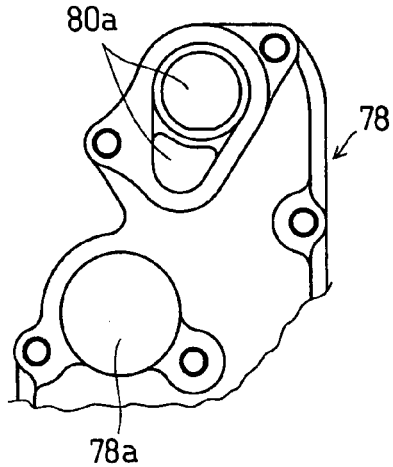
FIG. 11C is a view taken in the direction of the arrow c in FIG. 11A.

Referring to FIGS. 6, 9 and 10, the exhaust passage core has a part for forming the outlet 38*e* of the exhaust manifold passage 38, and a part for forming a through hole or parts for forming a plurality of through holes, namely, parts for forming the two through holes 91 and 92 in this embodiment. Those parts of the exhaust passage core are provided with cylindrical protrusions (core prints), respectively. The core prints of those parts of the exhaust passage core are supported on supporting parts of a master mold. The through holes 91 and 92 are necessary for supporting the exhaust passage core on the master mold.

Figure 7:
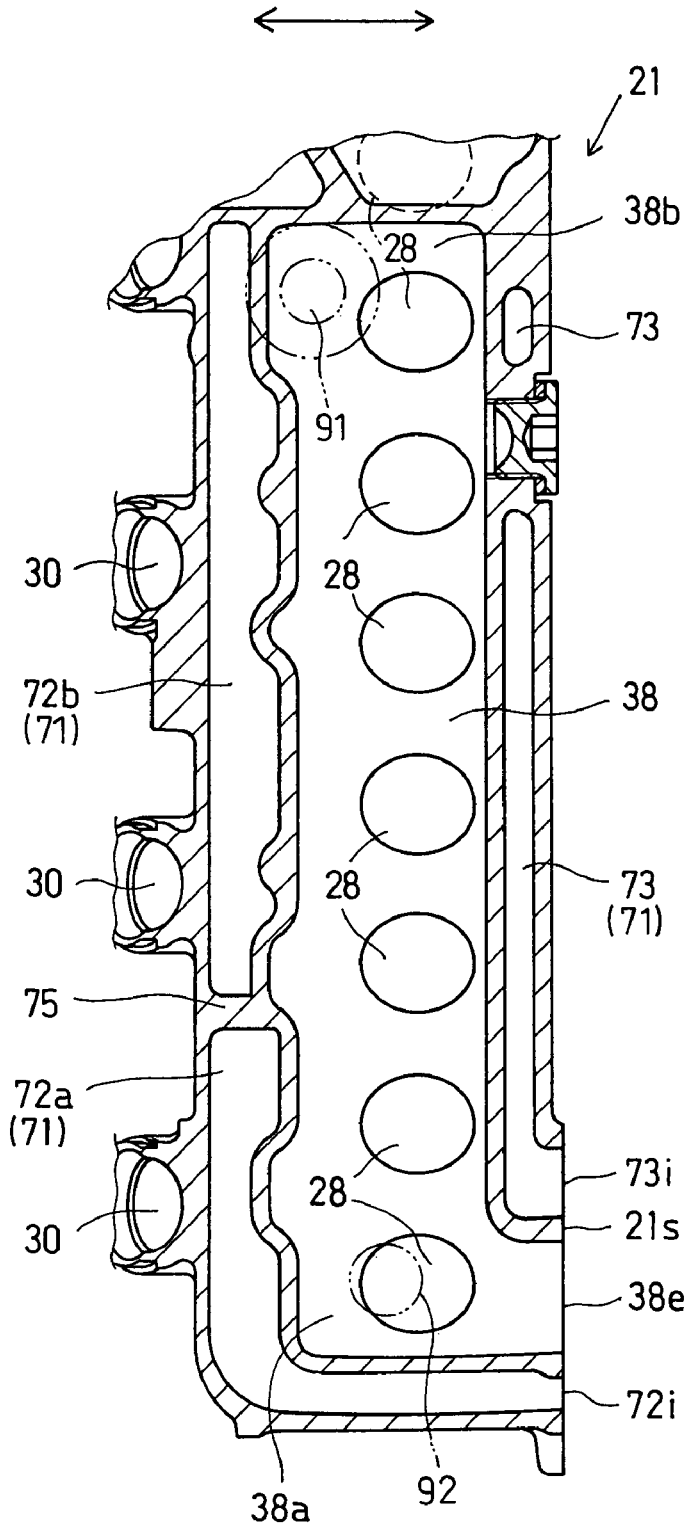
FIG. 7 is a schematic sectional view taken on the line VII-VII in FIG. 3.

As shown in FIG. 7, the through holes 91 and 92 are formed in an upper end part 38*b* and a lower end part 38*a* of the exhaust manifold passage 38, respectively. Thus the through hole 91 overlaps with the exhaust port 28 for the uppermost cylinder C4 (FIG. 12), and the through hole 92 overlaps with the exhaust port 28 for the lowermost cylinder C1. The through hole 92 overlaps with the outlet 38*e* with respect to the direction parallel to the row of the cylinders C1 to C4 and is separated from the outlet 38*e* with respect to the direction parallel to the axes of the cylinders C1 to C4. Thus the outlet 38*e* and the through hole 91, similarly to the through holes 91 and 92, are spaced apart from each other by a distance nearly equal to the length of the exhaust manifold passage 38, namely, a dimension with respect to the direction parallel to the row of the cylinders C1 to C4, or the longest possible distance.

As shown in FIG. 7, the water jacket 72 on the far side of the combustion chamber and the water jacket 73 on the near side of the combustion chamber are spaced from each other with respect to the direction parallel to the axes of the cylinders C1 to C4 in a range corresponding to the whole exhaust manifold passage 38 with respect to the direction parallel to the row of the cylinders C1 to C4. The through holes 91 and 92, namely, round holes having a circular section, are formed in a space between the water jackets 72 and 73 with respect to the direction parallel to the axes of the cylinders C1 to C4 with their axes extended parallel to the joining surface 21*s* so as to penetrate the exhaust passage wall $W_e$.

As shown in FIG. 6, an exhaust gas sensor 93 for measuring properties of the exhaust gas, such as a LAF measuring device (linear air-fuel ratio measuring device) for measuring the air-fuel ratio of the exhaust gas or an oxygen sensor for measuring the amount of oxygen in the exhaust gas, is passed through a through hole 78*a* formed in a water passage cover 78 to be described later and is inserted in the through hole 91. Although the through hole 92 is stopped with a plug in this embodiment, an exhaust gas sensor may be inserted in the trough hole 92. In the finished cylinder head 21, the through holes 91 and 92 are finished by machining, such as thread cutting, according to the purpose of the through holes 91 and 92.

Referring to FIGS. 3 and 7, the water jacket 72 on the far side of the combustion chamber and the water jacket 73 on the near side of the combustion chamber have portions extending along the outlet 38*e* of the exhaust manifold passage 38, and inlets 72*i* and 73*i* opening to the joining surface 23*s*, respectively. These inlets 72*i* and 73*i* communicate with the second and third inlet water passages 63 and 64 (FIG. 2) at the joining surface 21*s*, respectively. Part of the cooling water in the water jacket 72 on the far side of the combustion chamber flows into the water jacket 73 on the near side of the combustion chamber in the neighborhood of the inlets 72*i*.

Referring to FIGS. 3 and 7, the water jacket 72 on the far side of the combustion chamber is divided into an upstream water jacket 72*a* and a downstream water jacket 72*b* by a partition wall 75, namely, a flow restricting means (see also FIG. 1). The partition wall 75 stops or restricts the flow of the cooling water from the upstream water jacket 72*a* into the downstream water jacket 72*b*. Therefore, the cooling water in the upstream water jacket 72*a* flows from a part on the upstream side of the partition wall 75 into the combustion chamber water jacket 70 and, at the same time, flows through an inlet passage 76 (FIG. 9) into the side water jacket 74 (FIGS. 4 and 5), namely, a bypass water jacket.

The partition wall 75 lies between the combustion chamber 26*a* (FIG. 3) of the lowermost cylinder C1 nearest to the outlet 38*e* of the exhaust passage and the inlets 72*i* and 73*i*, and the combustion chamber 26*b* (FIG. 3) adjacent to the combustion chamber 26*a*. That is, the partition wall 75 lies between the combustion chambers 26*a* and 26*b*.

Referring to FIG. 9, the side water jacket 74 communicates with the upstream water jacket 72*a* by way of a plurality of connecting passages, namely, two inlet connecting passages 76 in this embodiment, formed in the cylinder head 21. The side water jacket 74 communicates with the downstream water jacket 72*b* by way of at least one connecting passage, namely, two outlet connecting passages 77 in this embodiment, provided in the cylinder head 21. Referring also to FIGS. 6, 11A, 11B and 11C, the side water jacket 74 and the outlet water jacket 80*b* are defined by a recess formed in the exhaust passage wall $W_e$ on the far side of the center plane by the master mold in casting the cylinder head 21, and a water passage cover 78 attached to the exhaust passage wall $W_e$.

Thus part of the cooling water in the upstream water jacket 72*a* flows through the inlet connecting passages 76, the side water jacket 74 and the outlet connecting passages 77 into the downstream water jacket 72*b*. The cooling water flows from the downstream water jacket 72*b* from a part on the downstream side of the partition wall 75 into the combustion chamber water jacket 70. Most part of the cooling water that has flowed out from the downstream water jacket 72*b* flows into a part of the combustion chamber water jacket 70 around the combustion chambers 26 excluding the lower end combustion chamber 26*a* (FIG. 3). The inlet connecting passages 76, the side water jacket 74 and the outlet connecting passages 77 constitute a connecting water passage for carrying the cooling water from the upstream water jacket 72*a* into the downstream water jacket 72*b*.

Figure 12:
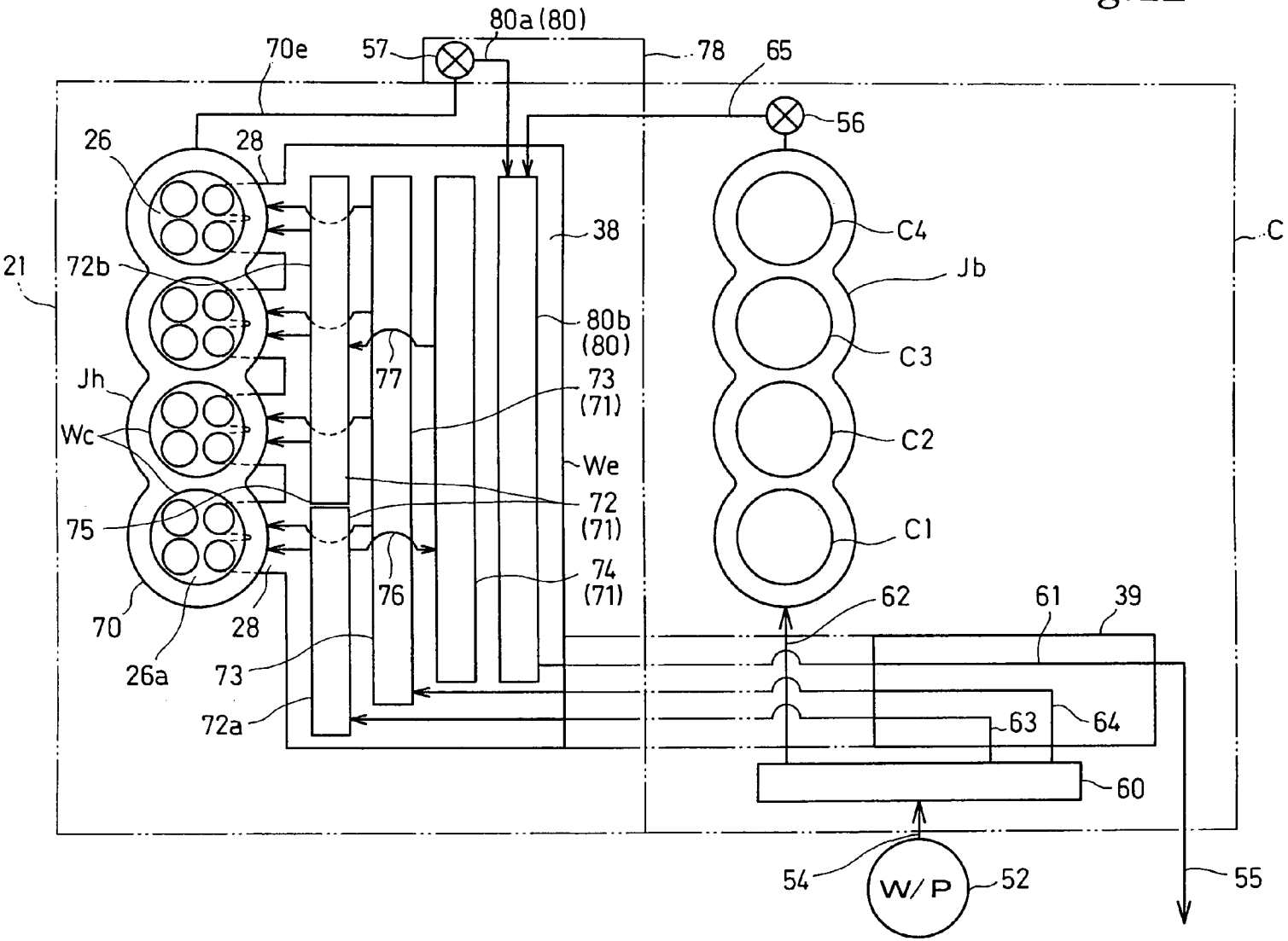
FIG. 12 is a typical view of a cooling system included in the water-cooled internal combustion engine shown in FIG. 1.

As shown in FIG. 12, parts of the water jacket 73 on the near side of the combustion chamber respectively corresponding to the combustion chambers 26 are connected to the combustion chamber water jacket 70 to make all the cooling water that has cooled the exhaust passage wall $W_e$ forming the exhaust manifold passage 38 flow into the combustion chamber water jacket 70.

Referring to FIGS. 6, 9, 11A, 11B and 11C, the cooling water flows through the water jacket 72 on the far side of the combustion chamber, the side water jacket 74 and the water jacket 73 on the near side of the combustion chamber, thus cooling the exhaust passage wall $W_e$ forming the exhaust passage. Then, the cooling water flows through the combustion chamber water jacket 73, cooling the combustion chamber wall $W_c$ forming the combustion chambers 26. Then, the cooling water flows through the outlet 70*e* (FIG. 11B) of the combustion chamber jacket 70 into the outlet water passage 80 of the cylinder head 21. The outlet water passage 80 includes the outlet water jacket 80*b* nearer to the combustion chambers 26 than the side water jacket 74 and extending parallel to the side water jacket 74 in the direction parallel to the row of the cylinders C1 to C4, and a water passage 80*a* having an inlet connected to the outlet 70*e* and an outlet opening into the outlet water jacket 80*b* and provided with the thermostat valve 57 for the cylinder head 21. A thermostat cover 57*a* is attached to the water passage cover 78. Referring to FIGS. 2, 3 and 8, the outlet water jacket 80*b* has an outlet opening in the joining surface 21*s* of the cylinder head 21 and connected to the drain port 61 (FIG. 8A). The drain port 61 has an inlet opening in the joining surface 21*s* of the cylinder head 21 and an outlet opening in the joining surface $C_m$ on which the gasket is placed. The cooling water flows through the outlet of the drain port 61 into the drain passage 55 (FIG. 1) of the mount case 1.

The water passage 80*a* connects with the upper end 80*b*2 (FIG. 9) of the outlet water jacket 80*b*. The drain port 61 (FIG. 8A) of the cylinder block C connects with the lower end 80*b*1 (FIG. 9) of the outlet water jacket 80*b*. The thermostat valve 57 (FIG. 11B) is placed in the water passage 80*a* formed in the water passage cover 78 so as to extend between the outlet 70*e* of the combustion chamber jacket 70 and the water passage 80*a*. The cooling water in the combustion chamber water jacket 70 flows through the thermostat valve 57, when the same is opened, and through the water passage 80*a* into the outlet water jacket 80*b*, and then the cooling water flows through the drain port 61 into the drain passage 55 (FIG. 1).

In this embodiment, the combustion chamber water jacket 70 communicates with the water jacket $J_b$ by means of openings 79 (FIG. 3) formed in the gasket. These openings 79 may be omitted.

The inlet 71*i* (FIG. 3) of the exhaust passage water jacket 71 includes only the inlet 72*i* (FIG. 7) of the upstream water jacket 72*a* and the inlet 73*i* (FIG. 7) of the water jacket 73 on the near side of the combustion chamber. Therefore, only the inlet 71*i* of the exhaust passage water jacket 71 is the inlet of cylinder head water jacket $j_h$, and only the outlet 70*e* of the combustion chamber water jacket 70 is the outlet of the cylinder head water jacket $J_h$.

The cooling water passage system includes, as principal systems, a heat exchange system for cooling the engine body, a water supply system for supplying the cooling water pumped by the water pump 52 to the heat exchange system, and a drain system for draining the cooling water discharged from the heat exchange system. The water supply system includes the supply port 60 (FIG. 8A) and inlet water passages 62, 63 and 64 (FIG. 2). The heat exchange system includes the water jackets $J_b$ and $J_h$. The drain system includes the outlet water passages 65 and 80 (FIG. 8) and the drain port 61 (FIG. 8A).

The flow of the cooling water will be described mainly in connection with FIG. 12.

The water-cooled internal combustion engine E is started. Then, the drive shaft 9 (FIG. 1) driven by the crankshaft 25 drives the water pump 52. The water pump 52 pumps up the cooling water through the water intake 51 and discharges the cooling water into the supply port 60. The cooling water flows from the supply port 60 through the first inlet water passage 62 into the water jacket $J_b$. The cooling water that has cooled the cylinders C1 to C4 flows through the cylinder block outlet water passage 65 into the outlet water jacket 80*b* of the cylinder head 21 when the thermostat valve 56 is open.

The cooling water flows from the supply port 60 through the second inlet water passage 63 into the upstream water jacket 72*a* of the water jacket 72 on the far side of the combustion chamber and through the third inlet water passage 64 into the combustion chamber water jacket 73. Part of the cooling water that has flowed into the upstream water jacket 72*a* flows from the part on the upstream side of the partition wall 75, namely, the flow restricting means, into the part around the lower end combustion chamber 26*a* of the combustion chamber water jacket 70 to cool the combustion chamber wall $W_c$ and the exhaust passage wall forming the exhaust ports 28 opening into the combustion chambers 26. Part of the cooling water that has flowed into the upstream water jacket 72*a* flows through the inlet passage 76 into the side water jacket 74, and then flows through the outlet passage 77 into the downstream water jacket 72*b*. The cooling water flowing through the water jackets 72*a*, 72*b*, 73 and 74 cools the exhaust passage wall $W_c$ forming the exhaust manifold passage 38. The cooling water that has flowed into the downstream water jacket 72*b* flows mainly into parts, around the combustion chambers 26 excluding the lower end combustion chamber 26*a*, of the combustion chamber water jacket 70 to cool the combustion chamber wall $W_c$ forming the combustion chambers 26 and the exhaust passage wall forming the exhaust ports 28 opening into the combustion chambers 26. The cooling water that has flowed into the water jacket 73 on the near side of the combustion chamber cools the exhaust passage wall $W_e$, and then flows into the combustion chamber water jacket 70.

The cooling water that has flowed into the combustion chamber water jacket 70 cools the combustion chamber wall $W_c$ forming the combustion chambers 26 and the exhaust passage wall forming the exhaust ports 28 and, when the thermostat valve 57 is open, flows through the outlet 70*e* into water passages 80*a* and 80*b* of the outlet water passage 80. The cooling water flows further along the cylinder block exhaust passage 39 and through the drain port 61 into the drain passage 55 of the mount case 1. Since the cooling water flowing through the outlet water jacket 80*b* cools the exhaust passage wall $W_e$ forming the exhaust manifold passage 38, the exhaust passage wall $W_e$ is cooled efficiently.

During the warm-up of the water-cooled internal combustion engine E, the thermostat valves 56 and 57 are closed and hence the cooling water in the cylinder head water jacket $J_h$, the combustion chamber water jacket 70 and the exhaust passage water jacket 71 does not flow to promote the warm-up of the water-cooled internal combustion engine E. If the pressure in the cooling water supply passage 54 increases excessively, a relief valve, not shown, placed in the cooling water supply passage 54 opens to discharge the surplus cooling water into the extension case 3.

The operation and effect of the water-cooled internal combustion engine E embodying the present invention will be described.

The exhaust passage water jacket 71 included in the cylinder head water jacket $J_h$ is divided into the upstream water jacket 72*a* and the downstream water jacket 72*b* by the partition wall 75, namely, the flow restricting means, the cooling water in the upstream water jacket 72*a* flows from the part on the upstream side of the partition wall 75 into the combustion chamber water jacket 70. Thus the partition wall 75 forces the cooling water contained in the upstream water jacket 72*a* into the combustion chamber water jacket 70. Consequently, a large amount of the cooling water, as compared with an amount of the cooling water that will flow into the combustion chamber water jacket 70 when the water-cooled internal combustion engine E is not provided with the partition wall 75, is used for cooling the combustion chamber wall $W_c$, and the combustion chamber wall $W_c$ can be effectively cooled. The exhaust passage wall $W_e$ forming the exhaust manifold passage 38 is cooled by the cooling water flowing through the exhaust passage water jacket 71 on the upstream side of the combustion chamber water jacket 70. Consequently, the uniformity of the temperature distribution on the combustion chamber wall $W_c$ and the exhaust passage wall $W_e$ can be improved and the uniformity of the temperature distribution on the cylinder head 21 is improved.

The cooling water flows from the downstream water jacket 72*b* from the part on the downstream side of the partition wall 75 into the combustion chamber water jacket 70. Thus the cooling of the combustion chamber wall $W_c$ is promoted and the uniformity of the temperature distribution on the cylinder head 21 is improved still further.

Part of the cooling water that has flowed into the upstream water jacket 72*a* flows through the connecting water passages 76, 74 and 77 into the downstream water jacket 72*b*. Thus the cooling of the exhaust passage wall $W_e$ forming the exhaust manifold passage 38 by the downstream water jacket 72*b* is promoted.

Part of the cooling water that has flowed into the upstream water jacket 72*a* flows through the side water jacket 74 into the downstream water jacket 72*b*. Thus the exhaust passage wall $W_e$ forming the exhaust manifold passage 38 is cooled by the cooling water that flows through the side water jacket 74. Consequently, the exhaust passage wall $W_e$ forming the exhaust manifold passage 38 is cooled by the cooling water flowing through the side water jacket 74 in addition to the cooling water flowing through the upstream water jacket 72*a* and the downstream water jacket 72*b* to promote the cooling of the exhaust passage wall $W_e$ forming the exhaust manifold passage 38.

The inlet 71*i* of the exhaust passage water jacket 71 coincides with the inlet 72*i* of the upstream water jacket 72*a*. Therefore, the combustion chamber wall $W_c$ and the exhaust passage wall $W_e$ are cooled concurrently by the cooling water from the upstream water jacket 72*a* and the cooling water from the downstream water jacket 72*b*. Thus the cooling water flows in a serial flow from the exhaust passage water jacket 71 into the combustion chamber water jacket 70. Consequently, The exhaust passage wall $W_e$ and the combustion chamber wall $W_c$ are cooled effectively by the cooling water from the upstream water package 72*a* and the downstream water jacket 72*b*.

All the cooling water that has flowed through the water jacket 73 on the near side of the combustion chamber to cool the exhaust passage wall $W_e$ forming the exhaust manifold passage 38, in addition to the cooling water from the water jacket 72 on the far side of the combustion chamber, flows into the combustion chamber water jacket 70. Thus the cooling of the combustion chamber wall $W_c$ is improved still further.

The inlet of the cylinder head water jacket $J_h$ coincides with the inlet 71*i* of the exhaust passage water jacket 71, and the outlet of the cylinder head water jacket $J_h$ coincides with the outlet 70*e* of the combustion chamber water jacket 70. Thus the cooling water flows in a serial flow from the exhaust passage water jacket 71 into the combustion chamber water jacket 70. Consequently, the exhaust passage wall $W_e$ forming the exhaust manifold passage 38 and the combustion chamber wall $W_c$ are cooled effectively by the cooling water flowing through the exhaust passage water jacket 71 of the cylinder head water jacket $J_h$.

The exhaust passage water jacket 71 formed by casting in a mold includes the water jacket 72 on the far side of the combustion chamber and the water jacket 73 on the near side of the combustion chamber respectively extending on the opposite sides, with respect to the direction parallel to the axes of the cylinders C1 to C4, of the exhaust manifold passage 38 formed by a core of a casting mold, the cylinder head 21 is provided with the outlet 38*e* of the exhaust manifold passage 38 and the through hole 91 opening into the exhaust manifold passage 38 and spaced from the inlet 38*e*, and the through hole 91 is formed between the water jacket 72 on the far side of the combustion chamber and the water jacket 73 on the near side of the combustion chamber spaced from each other with respect to the direction parallel to the axes of the cylinders C1 to C4. Therefore, the exhaust passage wall $W_e$ forming the exhaust manifold passage 38 is cooled effectively by the cooling water flowing through the water jacket 72 on the far side of the combustion chamber and the water jacket 73 on the near side of the combustion chamber respectively extending on the opposite sides, with respect to the direction parallel to the axes of the cylinders C1 to C4, of the exhaust manifold passage 38. The core of the casting mold for forming the exhaust passage can be supported by the outlet 38*e* of the exhaust manifold passage 38 and the through hole 91 spaced from the outlet 38*e*. Since the through hole 91 is formed between the water jacket 72 on the far side of the combustion chamber and the water jacket 73 on the near side of the combustion chamber spaced from each other with respect to the direction parallel to the axes of the cylinders C1 to C4, the through hole 91 will not make the respective shapes of the water jackets 72 and 73 complicated. Thus the core for forming the exhaust passage can be easily supported and the cylinder head can be manufactured at a low manufacturing cost.

When the exhaust manifold passage 38, the water jacket 72 on the far side of the combustion chamber and the water jacket 73 on the near side of the combustion chamber are viewed from a position farther from the center plane than the exhaust manifold passage 38, the water jackets 72 and 73 do not entirely cover the exhaust manifold passage 38 and the through holes 91 and 92 from the far side of the center plane with respect to the exhaust manifold passage 38. Therefore, the core for forming the exhaust passage can be inserted into the master mold without being interfered with by the mold for forming the water jackets 72 and 73. Thus the insertion of the core for forming the exhaust passage into the master mold is facilitated.

The outlet 38*e* and the through hole 91 are formed in the lower end part 38*a* and 38*b*, with respect to the direction parallel to the axes of the cylinders C1 to C4, of the exhaust manifold passage 38, respectively. Therefore, the parts supporting the core for forming the exhaust passage are spaced a long distance apart from each other. Thus the core can be stably supported on the support part.

The outlet 38*e* opens in the joining surface 21*s*, and the through holes 91 and 92 penetrate the cylinder head 21 parallel to the joining surface 21*s*. Therefore, the mold supporting the core for forming the exhaust passage can be extracted from the mold in a direction parallel to the joining surface 21*s* in which the outlet 38*e* opens. Thus the mold can be simply parted. Consequently, rational mold parting can be achieved and the cylinder head 21 can be manufactured at a low manufacturing cost.

The exhaust gas sensor 93 is received in the through hole 91 formed to support the core for forming the exhaust passage. Therefore, any additional through hole specially for receiving the exhaust gas sensor 93 is not necessary and hence the manufacturing cost of the cylinder head 21 can be reduced. Since the through hole 91 does not penetrate the water jacket 72 on the far side of the combustion chamber and the water jacket 73 on the near side of the combustion chamber, the area of parts of the exhaust passage walls covered with the water jackets 72 and 73 is not reduced by the through hole 91 for receiving the exhaust gas sensor 93 and hence the cooling effect of the cooling water flowing through the water jackets 72 and 73 will not be deteriorated.

The cylinder block outlet water passage 65 and the cylinder head outlet water passage 80 are connected and the drain system includes the outlet water passages 65 and 80. Therefore, the cylinder block C does not need to be provided with an additional outlet water passage connected to the drain passage 55 in addition to the outlet water passage 80 and hence the cylinder block C can be formed in a small size.

Modifications in the Foregoing Embodiment Will be Described.

The partition wall 75 serving as a flow restricting means may be provided with an orifice to permit the cooling water to flow from the upstream water jacket 72*a* into the downstream water jacket 72*b* at a low flow rate The side water jacket 74 may be omitted and the partition wall 75 may be provided with a connecting passage that permits the cooling water to flow from the upstream water jacket 72*a* into the downstream water jacket 72*b* at a flow rate equal to that at which the cooling water flows through the side water jacket 74.

The upstream water jacket 72*a* and the downstream water jacket 72*b* may communicate with the supply port 60 by means of separate inlet water passages, respectively. When the upstream water jacket 72*a* and the downstream water jacket 72*b* are thus connected to the supply port 60, the side water jacket 74 may be either formed or omitted.

A tube other than the exhaust gas sensor 93, such as an exhaust gas sampling tube for sampling the exhaust gas flowing through the exhaust manifold passage 38, a tube for opening the exhaust manifold passage 38 into the atmosphere or a secondary air supply tube for supplying secondary air for purifying the exhaust gas, may be inserted in the through hole 91. The through hole 91 may penetrate the cylinder head 21 in the direction parallel to the row of the cylinders.

The water-cooled internal combustion engine E may be applied to machines other than marine propulsion devices, such as vehicles.

What is claimed is:

1. A water-cooled internal combustion engine comprising:

a cylinder block provided with a plurality of cylinders aligned in a row; and a cylinder head defining combustion chambers respectively corresponding to the cylinders, and provided integrally therein with an exhaust manifold passage into which exhaust gas discharged from the combustion chambers flows through exhaust ports connected to the combustion chamber, and a cylinder head water jacket for cooling water including a combustion chamber water jacket surrounding the combustion chambers and an exhaust passage water jacket around the exhaust manifold passage;

wherein said exhaust manifold passage extends in the cylinder head over the exhaust ports;

wherein the exhaust passage water jacket is divided into an upstream water jacket and a downstream water jacket by a flow restriction which stops or restricts cooling water flow from the upstream water jacket into the downstream water jacket, said exhaust passage water jacket extending along the exhaust manifold passage;

a part of the upstream water jacket on an upstream side of the flow restriction is connected to the combustion chamber water jacket to make the cooling water flow from the upstream water jacket into the combustion chamber water jackets; and the downstream water jacket is connected to the combustion chamber water jacket so that the cooling water flowing through the downstream water jacket flows from the downstream water jacket into the combustion chamber water jacket.

2. A water-cooled internal combustion engine comprising:

a cylinder block provided with a plurality of cylinders aligned in a row; and a cylinder head defining combustion chambers respectively corresponding to the cylinders, and provided integrally therein with an exhaust manifold passage into which exhaust gas discharged from the combustion chambers through exhaust ports flows, and a cylinder head water jacket for cooling water including a combustion chamber water jacket surrounding the combustion chambers and an exhaust passage water jacket around the exhaust manifold passage;

wherein the exhaust passage water jacket is divided into an upstream water jacket and a downstream water jacket by a flow restriction which stops or restricts cooling water flow from the upstream water jacket into the downstream water jacket;

a part of the upstream water jacket on an upstream side of the flow restriction is connected to the combustion chamber water jacket to make the cooling water flow from the upstream water jacket into the combustion chamber water jacket;

the downstream water jacket is connected to the combustion chamber water jacket so that the cooling water flowing through the downstream water jacket flows from the downstream water jacket into the combustion chamber water jacket;

and wherein the cylinder head is provided with connecting passages through which part of the cooling water flowing in the upstream water jacket flows into the downstream water jacket.

3. A water-cooled internal combustion engine comprising:

a cylinder block provided with a plurality of cylinders aligned in a row; and a cylinder head defining combustion chambers respectively corresponding to the cylinders, and provided integrally therein with an exhaust manifold passage into which exhaust gas discharged from the combustion chambers through exhaust ports flows, and a cylinder head water jacket for cooling water including a combustion chamber water jacket surrounding the combustion chambers and an exhaust passage water jacket around the exhaust manifold passage;

wherein the exhaust passage water jacket is divided into an upstream water jacket and a downstream water jacket by a flow restriction which stops or restricts cooling water flow from the upstream water jacket into the downstream water jacket;

a part of the upstream water jacket on an upstream side of the flow restriction is connected to the combustion chamber water jacket to make the cooling water flow from the upstream water jacket into the combustion chamber water jacket;

the downstream water jacket is connected to the combustion chamber water jacket so that the cooling water flowing through the downstream water jacket flows from the downstream water jacket into the combustion chamber water jacket;

and wherein the cylinder head is provided with a bypass water jacket through which part of the cooling water flowing in the upstream water jacket flows into the downstream water jacket, the bypass water jacket serving also as the exhaust passage water jacket.

4. A water-cooled internal combustion engine comprising:

a cylinder block provided with a plurality of cylinders aligned in a row; and a cylinder head defining combustion chambers respectively corresponding to the cylinders, and provided integrally therein with an exhaust manifold passage into which exhaust gas discharged from the combustion chambers through exhaust ports flows, and a cylinder head water jacket for cooling water including a combustion chamber water jacket surrounding the combustion chambers and an exhaust passage water jacket around the exhaust manifold passage;

wherein the exhaust passage water jacket is divided into an upstream water jacket and a downstream water jacket by a flow restriction which stops or restricts cooling water flow from the upstream water jacket into the downstream water jacket;

a part of the upstream water jacket on an upstream side of the flow restriction is connected to the combustion chamber water jacket to make the cooling water flow from the upstream water jacket into the combustion chamber water jacket, and the downstream water jacket is connected to the combustion chamber water jacket so that the cooling water flowing through the downstream water jacket flows from the downstream water jacket into the combustion chamber water jacket;

wherein the cylinder head is provided with a connecting passages through which part of the cooling water flowing in the upstream water jacket flows into the downstream water jacket;

and wherein the exhaust passage water jacket has an inlet, the upstream water jacket has an inlet, and those inlets coincide with each other.

5. A water-cooled internal combustion engine comprising:

a cylinder block provided with a plurality of cylinders aligned in a row; and a cylinder head defining combustion chambers respectively corresponding to the cylinders, and provided integrally therein with an exhaust manifold passage into which exhaust gas discharged from the combustion chambers through exhaust ports flows, and a cylinder head water jacket for cooling water including a combustion chamber water jacket surrounding the combustion chambers and an exhaust passage water jacket around the exhaust manifold passage;

wherein the exhaust passage water jacket is divided into an upstream water jacket and a downstream water jacket by a flow restriction which stops or restricts cooling water flow from the upstream water jacket into the downstream water jacket;

a part of the upstream water jacket on an upstream side of the flow restriction is connected to the combustion chamber water jacket to make the cooling water flow from the upstream water jacket into the combustion chamber water jacket;

the downstream water jacket is connected to the combustion chamber water jacket so that the cooling water flowing through the downstream water jacket flows from the downstream water jacket into the combustion chamber water jacket;

and wherein an inlet of the cylinder head water jacket serves as an inlet of the exhaust passage water jacket, and an outlet of the cylinder head water jacket serves as an outlet of the combustion chamber water jacket.

* * * * *